United States Patent [19]

Papp et al.

[11] Patent Number: 4,560,212

[45] **Date of Patent: * Dec. 24, 1985**

[54] THREE PART BALL BEARING SLIDE WITH LOCKABLE INTERMEDIATE SLIDE MEMBER

[75] Inventors: John E. Papp, Anaheim; Antony S. Reed, Whittier, both of Calif.

[73] Assignee: Standard Precision, Inc., Santa Fe Springs, Calif.

[ * ] Notice: The portion of the term of this patent subsequent to Oct. 29, 2002 has been disclaimed.

[21] Appl. No.: 597,674

[22] Filed: Apr. 6, 1984

Related U.S. Application Data

[63] Continuation-in-part of Ser. No. 540,006, Oct. 7, 1983.

[51] Int. Cl.[4] ..... F16C 29/04; A47B 88/00

[52] U.S. Cl. ..... 308/3.8; 308/3.6; 312/348

[58] Field of Search ..... 308/3.6, 3.8; 312/333, 312/348, 338, 339, 342

[56] References Cited

U.S. PATENT DOCUMENTS

| | | | |
|---|---|---|---|
| 2,496,997 | 2/1950 | Hallberg | 312/348 X |
| 2,862,772 | 12/1958 | Gussack | 308/3.8 |
| 3,141,714 | 7/1964 | Valitus | 312/348 |
| 3,801,166 | 4/1974 | York | 308/3.8 |
| 3,860,308 | 1/1975 | Burke | 312/348 X |
| 4,101,178 | 7/1978 | Adams et al. | 308/3.6 |
| 4,441,772 | 4/1984 | Fielding | 312/348 X |

*Primary Examiner*—Stuart S. Levy
*Assistant Examiner*—Thomas R. Hannon
*Attorney, Agent, or Firm*—Edgar W. Averill, Jr.

[57] ABSTRACT

A precision ball bearing slide mechanism having a removable inner member. The slide is a three part slide having an outer, an intermediate and an inner slide member. A latch which holds the intermediate slide member in a locked out position is disclosed herein. This latch is released when the inner slide member is retracted.

5 Claims, 10 Drawing Figures

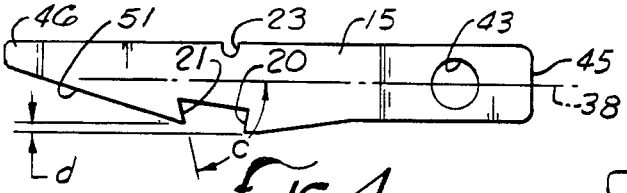
FIG. 4.
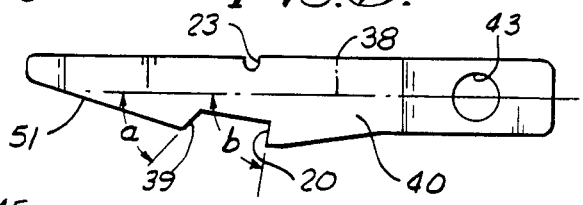
FIG. 6.
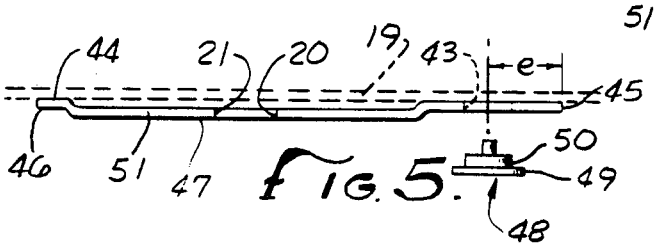
FIG. 5.
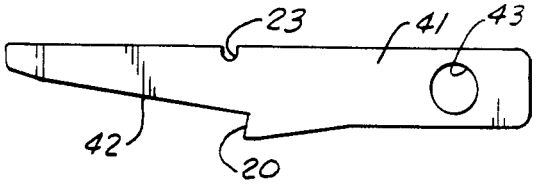
FIG. 7.
FIG. 8.
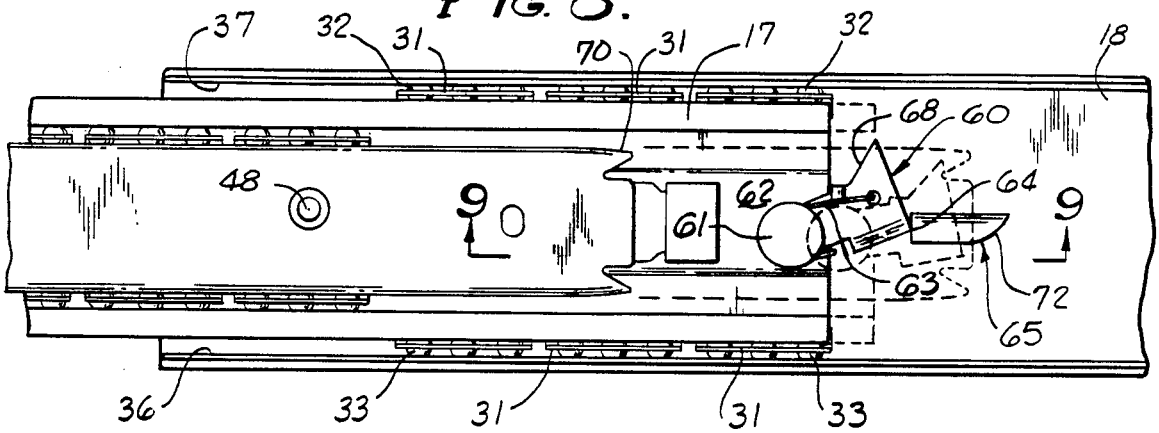
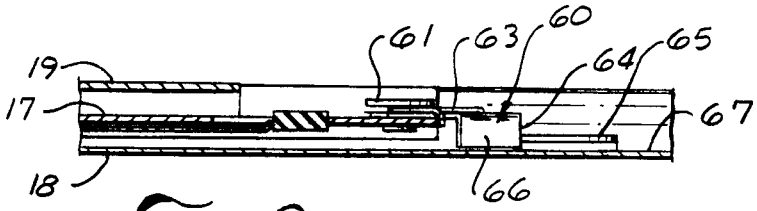
FIG. 9.
FIG. 10.
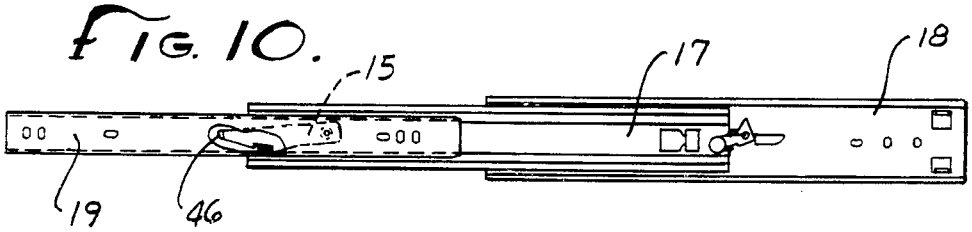

THREE PART BALL BEARING SLIDE WITH LOCKABLE INTERMEDIATE SLIDE MEMBER

CROSS REFERENCE TO RELATED APPLICATIONS

This application is a continuation-in-part of applicants' pending application filed Oct. 7, 1983, Ser. No. 540,006. The earlier application has the same title and the same inventors.

BACKGROUND OF THE DISCLOSURE

The field of the invention is ball bearing slides and the invention relates more particularly to precision ball bearings slide mechanisms of the type which permit the lateral removal of the inner slide member from the body of the slide so that the object supported by the slide may be removed from its mount and readily reinserted therein.

One method of removing the supported object is by lifting the object away from the inner slide member after the slide member has been extended. Pull-out, front-disconnect features are also known which utilize a layer or other release device which allows the inner member to be disconnected from the remainder of the slide assembly. One such locking and releasing feature is shown in U.S. Pat. No. 3,258,299. In this device, a pair of spring loaded arms are supported by the inner member and extend outwardly to contact the intermediate member and hold it in a fixed position with respect to the intermediate member. The intermediate member is locked to the outer member by a spring loaded catch which projects into a hole in the outer member. Such construction is relatively expensive to fabricate and has not found wide acceptance.

It is important that the device be both easy to operate and that it not add unduly to the cost of the slide.

SUMMARY OF THE INVENTION

The present invention is for a stop out and disconnectable ball bearing slide mechanism for stopping a telescoping slide in an extending position while permitting the inner member of the slide to be withdrawn or pulled out from the rest of the slide. The slide is of the type which has an outer slide member having two inwardly facing, parallel grooves formed along the edges thereof. The outer slide member has an outer end from which the slide telescopes and an inner end toward which the slide retracts. A first ball bearing retainer having a plurality of ball bearings held therein is moveable within and along the outer slide member and is positioned to hold the ball bearings in two axial rows, one of said rows being held along and against the first of the two parallel grooves and the other of the rows being held along the second of the parallel grooves. An intermediate slide member has two outwardly-facing parallel grooves and two inwardly-facing parallel grooves. A second ball bearing retainer having a plurality of ball bearings held therein is movable along the two inwardly-facing parallel grooves of the intermediate member. An inner slide member has two outwardly-facing parallel grooves formed along its edges and the inner slide member is slidable along the interior of the intermediate slide member and has the ball bearings touching the grooves thereof. The improvement of the present invention comprises a locking device which holds the intermediate slide member in an extended configuration with respect to the outer slide member. This locking device has a latch which is held on the intermediate member and has a stop surface at the inner end thereof and a cam surface extending in the path of travel of the inner slide member. When the inner slide member is released and moves inwardly, its inner end contacts the cam surface of the intermediate lock out latch and releases the intermediate member with respect to the outer member permitting the slide assembly to be completely retracted.

BRIEF DESCRIPTION OF THE DRAWINGS

FIG. 4 is a front view of one configuration of the latch of the present invention.

FIG. 5 is an exploded top view of the latch of FIG. 4 together with a shoulder rivet.

FIG. 6 is a side view of an alternate configuration of the latch of FIG. 4.

FIG. 7 is a side view of an alternate configuration of the latch of FIG. 4.

FIG. 8 is a fragmentary side view of the middle portion of the slide of the present invention.

FIG. 9 is a cross sectional view taken along line 9—9 of FIG. 8.

FIG. 10 is a front view, partially cut away of the slide of the present invention in an extended configuration.

DESCRIPTION OF THE PREFERRED EMBODIMENTS

Figure 1:
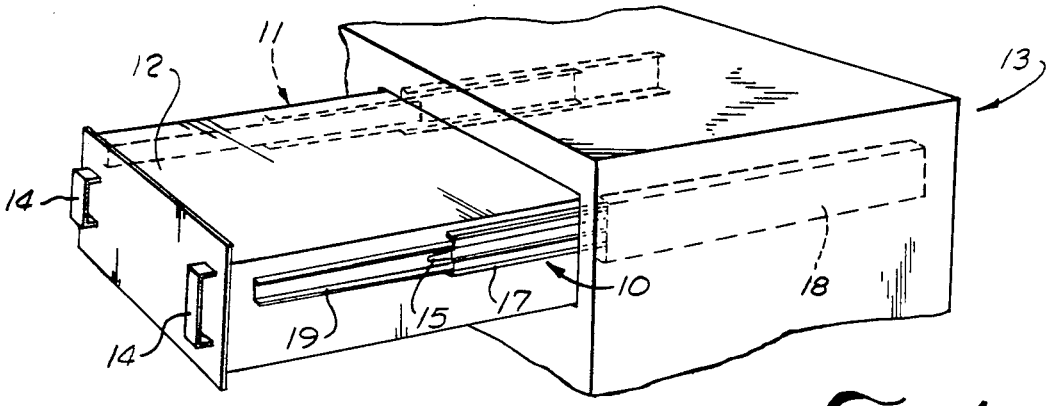
FIG. 1 is a perspective view of the slide of the present invention mounted on a chassis held in a cabinet.

With the ever increasing use of electronic equipment there is an increased need for support apparatus which permits the withdrawal of devices from a cabinet or other support member and the further removal of the device from its cabinet for servicing. Thus, it is beneficial that a slide be provided which permits an object to be withdrawn and stopped without being removed and yet be capable of removal by the simple moving of a lever. Such a slide is shown in perspective view in FIG. 1 and indicated generally by reference characters 10 and 11. Slides 10 and 11 hold a chassis 12 in a cabinet 13. A pair of handles 14 permit the easy pulling of the chassis 12 from cabinet 13 for operation or service or the like. Slides 10 and 11 have a stop feature so that when the slides reach their maximum extension, the chassis 12 cannot further be removed unless a further step is taken.

It is possible to completely remove chassis 12 from cabinet 13 by the movement of a pair of latches 15 so that chassis 12 can be serviced or otherwise reached or replaced. Slide 11, of course, also has a similar latch not shown.

Figure 2:
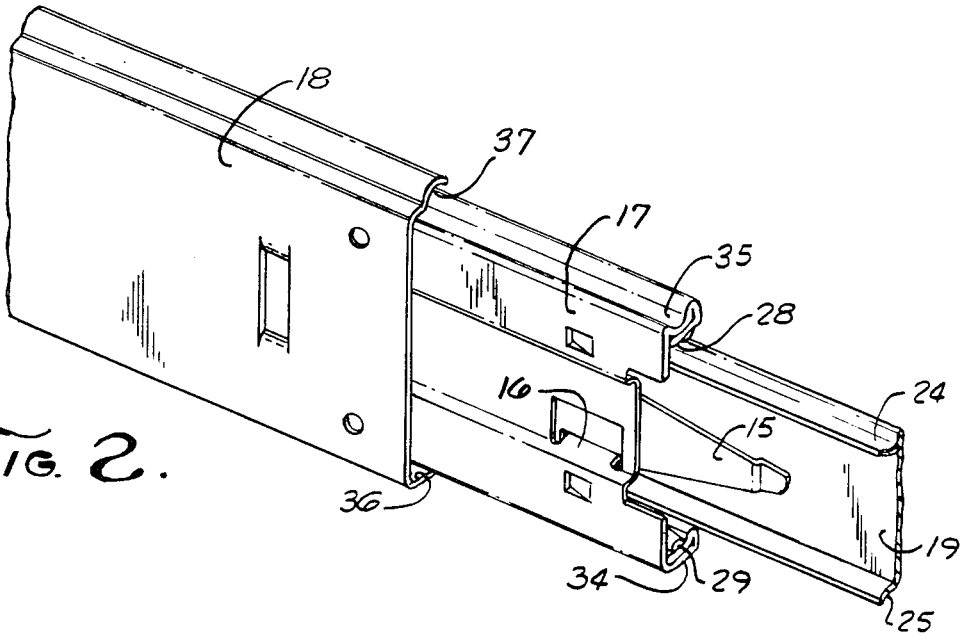
FIG. 2 is an enlarged perspective view, partially cut away, of the back of the middle portion of the slide of the present invention.
Figure 3:
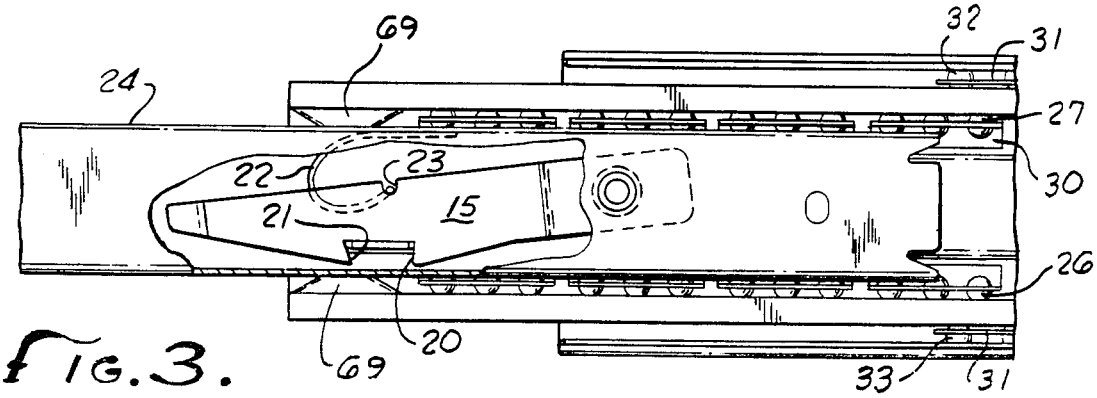
FIG. 3 is a front side view, partially cut away, showing the intermediate portion including the latch member of the outer portion of the slide of the present invention.

As seen more fully in FIGS. 2 and 3, latch 15 locks onto a lanced out tab 16 formed in intermediate member 17. Intermediate member 17 slides along outer member 18 which is affixed to the wall of cabinet 13. The inner slide member is identified by reference character 19.

Latch 15 has a first stop surface 20 shown in FIGS. 3 through 7 which abuts lanced out tab 16 which provides a stop means to prevent the removal of the inner slide member 19 from the intermediate member 17. Biasing means comprising a wire spring 22 rests in a notch 23 of latch 15 and presses against the under surface of the groove 24 of inner slide member 19. Inner slide member 19 has a lower groove 25 along which the row of ball bearings 26 roll. A row of ball bearings 27 roll against groove 24 and also against the inwardly facing parallel grooves 28 and 29 of the intermediate member 17. A conventional ball bearing retainer 30 holds the two rows of ball bearings 26 and 17 against the respective grooves. Similarly, a ball bearing retainer 31 holds two rows of ball bearings 32 and 33 against grooves 34 and 35 in intermediate member 17 and grooves 36 and 37 in outer slide member 18.

Turning now to FIGS. 4 through 7, it can be seen that latch member 15 may be made in several configurations depending upon the type of stop required. Latch 15 of FIG. 4 has two stop surfaces which, although generally normal or at right angles to the longitudinal axis 38, are preferably at an angle of about 80 degrees with respect to axis 38. In this way, first stop surface 20 is held about vertically with respect to the longitudinal axis of the inner slide member as shown best in the cut away portion of FIG. 10. Furthermore, it is advantageous that stop surface 20 extend further downwardly than stop surface 21 (this dimension is indicated in the drawings by the letter "d"). This eliminates the problem of unwanted release of the inner member if the inner member is rapidly withdrawn from the intermediate member.

The second stop surface 39 of latch 40 of FIG. 6 permits the retraction of the slide by the exertion of an inward force on the inner member. Unlike the latch of FIG. 4 which must be lifted to release the inner member, latch 40 may be lifted by pushing on the inner member which forces lanced out tab 16 against the second stop surface 39 and raises latch 40 releasing it from tab 16. Latch 41 of FIG. 7 has no second stop surface at all and instead has a recessed surface 42 which provides no resistance to the inner movement of the inner slide member.

In order to assist in the nomenclature of the slide of the present invention, the innermost ends of the slide members with respect to cabinet 13 are referred to herein as the "inner end." Likewise, the other end of each of the slide members is referred to as the "outer end".

Returning now to the specific configuration of the latch, it can be seen in FIG. 5 that the latch is formed basically in two different planes. One plane contains the pivot hole 43 which extends outwardly to the pivot end 45 and also contains the support tab 44 at the actuating end 46. The second plane 47 is bent outwardly away from the inner member which is shown in phantom view in FIG. 5. A shoulder rivet 48 has flat head 49 which assists to support latch 15 against the interior surface of inner member 19. Rivet 48 has a bearing surface 50 which permits the pivoting of latch 15 about it. As further shown in FIG. 5, the pivot end 45 extends outwardly away from the center of the pivot hole a distance indicated by the letter "e.". This distance is greater than that sufficient to support pivot hole 43 and provides an increased bearing surface to assist in holding the actuating end 46 of latch 15 against the interior surface of inner member 19.

In operation, as the inner slide member 19 moves outwardly with respect to the intermediate member 17, the lanced out tab 16 contacts the cam surface 51 permitting the second stop surface 21 to drop over tab 16 locking the inner member with respect to the intermediate member. In order to release the inner member with respect to the intermediate member, it is merely necessary to lift the actuating end 46 of latch 15 to disengage the second stop surface 21 from tab 16. The actuating end 46 extends past the outer end of the intermediate member as shown in the cut-out portion of FIG. 10.

Similarly, stop surface 20 of latch 40 strikes tab 16 on the intermediate member as it is being withdrawn therefrom. However, in order to retract the slide assembly, one needs merely push on inner member 19 and the second stop surface 39 provides a camming action with respect to tab 16 and raises latch 40 against the wire spring 22 which is held in notch 23. As stated above, latch 41 has no second stop surface and there is therefore no resistance to retracting inner member 19 when latch 41 is used.

An intermediate lock out latch 60 is held by a shoulder rivet 61 against the web 62 of intermediate member 17. Shoulder rivet 61 is constructed in a manner similar to shoulder rivet 48 in that it has an enlarged flat head which tends to support intermediate lock out latch 60 against web 62. A wire spring 63 urges latch 60 in a counter clockwise direction as viewed in FIG. 8 of the drawings. This causes the stop surface 64 to contact tab 65 which provides a stop means to prevent the inward movement of intermediate member 17 with respect to outer member 18. As can be seen best in FIG. 9, latch 60 has an arm 66 which extends in the direction of web 67 of the outer member 18. Arm 66 serves two purposes. First, it holds the stop surface against tab 65 to prevent withdrawal. Secondly, its upper surface contacts the curved cam surface 72 of tab 65. This causes latch 60 to be deflected to pass around tab 65 as the intermediate member is fully withdrawn.

As can be seen in FIGS. 8 and 9, intermediate member 17 is locked in an extended position which does not permit retraction of the slide until the inner member contacts the cam surface 68 of latch 60. The inner end 70 of inner slide member 19 is curved inwardly to assist the replacement of the inner member into the intermediate member after it has been withdrawn. A pair of plastic guide means 69 shown in FIG. 3 further facilitate this insertion. As seen in phantom view in FIG. 8, the intermediate latch 60 is forced downwardly against wire spring 63 which permits latch 60 to pass around tab 65 and permits the intermediate member to be retracted.

The slide assembly of the present invention is a particularly easy assembly to operate. In its basic configuration, the inner slide member cannot be withdrawn from the slide member which surrounds it (which may be referred to herein either as the first slide member or the intermediate slide member depending upon whether the slide is a two-part or three-part slide). Where the latch is configured as in FIG. 4, the inner slide member may not be withdrawn unless the latch member is lifted. Thus, for those installations where it is beneficial for the supported device to be operated in a pulled out or extended configuration, this may be readily brought about by merely pulling outwardly on handles 14 to the full extension of the slide which is then locked in the desired position. To remove the cabinet, the latches are merely lifted or to either withdraw or close the assembly, one also merely lifts the latches.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. In a lock-out or stop out and disconnectable three member slide mechanism for locking or stopping a telescoping slide in an extended position while permitting the slide to be disconnected, said slide mechanism comprising:

an outer slide member having two inwardly-facing, parallel grooves formed along the edges thereof, said outer slide member having an outer end from which the slide telescopes and an inner end toward which the slide retracts;

a first ball bearing retainer having a plurality of ball bearings held therein, said retainer being movable within and along said outer slide member and being positioned to hold the ball bearings in two axial rows one of said rows being held along and against the first of said two parallel grooves and the other of said rows being held along and against the second of said parallel grooves;

an intermediate slide member having two outwardly-facing parallel grooves and two inwardly-facing parallel grooves formed along the edges thereof, said intermediate slide member being slideable along the interior of the outer slide member and having the ball bearings which are held in the first ball bearing reatiner touching the outwardly-facing grooves thereof;

a second ball bearing retainer having a plurality of ball bearings held therein, said retainer being movable within and along said intermediate slide member and being positioned to hold the ball bearings in two axial rows one of said rows being held along and against the first of said two inwardly-facing parallel grooves and the other of said rows being held along and against the second of said inwardly-facing parallel grooves;

an inner slide member having two outwardly-facing parallel grooves formed along the edges thereof, said inner slide member being slideable along the interior of the interior slide member and having the ball bearings of the second ball bearing retainer touching the grooves thereof wherein the improvement comprises:

an intermediate lock-out latch pivotally held on said intermediate slide member near the inner end thereof, said intermediate lock-out latch having a stop surface at the inner end thereof and a cam surface extending in the path of travel of the inner slide member and further having biasing means urging the intermediate lock-out latch in the path of the inner slide member and wherein the outer slide member has stop means held thereon, said stop means being positioned so that the stop surface of the intermediate lock-out latch touches the stop means on the outer slide member when the intermediate slide member is fully extended from the outer slide member.

2. The slide mechanism of claim 1 wherein the inner end of said inner member is curved inwardly to assist in guiding the inner member into the first slide member.

3. The slide mechanism of claim 1 wherein the stop means on the outer slide member is a lanced parallel plate formed in the outer slide member.

4. The slide mechanism of claim 1 wherein said intermediate lock-out latch is held to the intermediate slide member by a shoulder rivet.

5. In a lock out and disconnectible slide mechanism for stopping a telescoping slide in an extended position while permitting the slide to be readily disconnected, said slide mechanism comprising:

an outer slide member having two inwardly-facing, parallel grooves formed along the edges thereof, said outer slide member having an outer end from which the slide telescopes and an inner end toward which the slide retracts;

an intermediate slide member having two inwardly-facing, parallel grooves formed along the edges thereof, two outwardly facing parallel grooves formed along the edges thereof, said intermediate slide member also having an outer end from which the slide telescopes and an inner end toward which the slide retracts;

a pair of ball bearing retainers having a plurality of ball bearings held therein, said retainers being movable within and along said slide members and each retainer being positioned to hold the ball bearings in two axial rows one of said rows being held along and against the first of each pair of parallel grooves and the other of said rows being held along and against the second of said pair of parallel grooves;

an inner slide member having two outwardly-facing parallel grooves formed along the edges thereof, said inner slide member being slideable along the interior of the intermediate slide member and having the ball bearings touching the grooves thereof; wherein the improvement comprises:

an intermediate lock-out latch pivotally held on said intermediate member said intermediate lock-out latch having a stop surface at the inner end thereof and a cam surface extending in the path of travel of the inner slide member and further having biasing means urging the intermediate lock-out latch in the path of the inner slide member and wherein the outer slide member has stop means held thereon, said stop means being positioned so that the stop surface of the intermediate lock-out latch touches the stop means on the outer slide member when the intermediate slide member is fully extended from the outer slide member.

* * * * *